US008460006B2

(12) United States Patent
Debock et al.

(10) Patent No.: US 8,460,006 B2
(45) Date of Patent: Jun. 11, 2013

(54) CONDUCTORS HELD BETWEEN A TERMINAL BODY AND A BASE CONNECTED TOGETHER

(75) Inventors: Kimberly Ann Debock, Hummelstown, PA (US); David James Fabian, Mount Joy, PA (US); Richard P. Walter, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/236,330

(22) Filed: Sep. 19, 2011

(65) Prior Publication Data

US 2012/0071039 A1 Mar. 22, 2012

Related U.S. Application Data

(60) Provisional application No. 61/384,593, filed on Sep. 20, 2010.

(51) Int. Cl.
*H01R 33/00* (2006.01)

(52) U.S. Cl.
USPC ..... 439/37

(58) Field of Classification Search
USPC ..... 439/37, 521, 752, 877, 495
See application file for complete search history.

(56) References Cited

U.S. PATENT DOCUMENTS

| | | | | |
|---|---|---|---|---|
| 3,728,473 | A * | 4/1973 | Kuo | 174/84 C |
| 6,032,293 | A * | 3/2000 | Makki | 2/209.13 |
| 6,319,015 | B1 | 11/2001 | Faunce | |
| 6,350,145 | B1 * | 2/2002 | Chen et al. | 439/422 |
| 6,461,188 | B2 * | 10/2002 | Reul | 439/422 |
| 6,561,814 | B2 | 5/2003 | Tilbury et al. | |
| 6,767,218 | B2 * | 7/2004 | Marmaropoulos | 439/37 |
| 6,863,539 | B2 * | 3/2005 | Marmaropoulos | 439/37 |
| 7,025,596 | B2 | 4/2006 | Zollo et al. | |
| 7,052,154 | B2 * | 5/2006 | Vanderschuit | 362/105 |
| 7,179,140 | B2 * | 2/2007 | Jung et al. | 439/877 |
| 7,210,939 | B2 | 5/2007 | Marmaropoulos et al. | |
| 7,365,031 | B2 | 4/2008 | Swallow et al. | |

(Continued)

FOREIGN PATENT DOCUMENTS

| | | | |
|---|---|---|---|
| EP | 2 107 642 | A2 | 10/2009 |
| GB | 2 050 208 | A | 1/1981 |
| WO | WO 2004/084353 | A1 | 9/2004 |

OTHER PUBLICATIONS

Annex to Form PCT/ISA/206 (Communication Relating to the Results of the Partial International Search), International Application No. PCT/US2011/001625, International Filing Date Sep. 20, 2011.

*Primary Examiner* — Chandrika Prasad

(57) ABSTRACT

A connector for an e-textile having a conductive layer that includes conductors includes a terminal and a base separately provided from the terminal. The terminal has a mating end and a mounting end. The mounting end is terminated to the e-textile's conductors. The mating end is configured to be mated with a mating contact of a mating component. The terminal has a body and a plurality of tines extending from the body. The base is arranged opposite the body of the terminal such that the e-textile's conductors are positioned between the base and the body of the terminal. The terminal is crimped to electrically connect the terminal and the base to the e-textile's conductor. The tines are folded against the base to electrically connect the terminal to the base. The body of the terminal and the base engage the e-textile's conductors.

22 Claims, 6 Drawing Sheets

U.S. PATENT DOCUMENTS

| | | | | |
|---|---|---|---|---|
| 7,462,035 | B2 | 12/2008 | Lee et al. | |
| 7,556,532 | B2 | 7/2009 | Lee et al. | |
| 7,658,612 | B2 | 2/2010 | Lee et al. | |
| 7,731,517 | B2 | 6/2010 | Lee et al. | |
| 7,753,685 | B2 | 7/2010 | Lee et al. | |
| 2004/0244193 | A1 * | 12/2004 | Jung et al. | 29/854 |
| 2004/0259391 | A1 * | 12/2004 | Jung et al. | 439/37 |
| 2006/0124193 | A1 | 6/2006 | Orr et al. | |
| 2010/0048066 | A1 | 2/2010 | Bertsch et al. | |
| 2010/0100997 | A1 | 4/2010 | Lee et al. | |

* cited by examiner

CONDUCTORS HELD BETWEEN A TERMINAL BODY AND A BASE CONNECTED TOGETHER

CROSS REFERENCE TO RELATED APPLICATION

The present application relates to and claims priority from Provisional Application Ser. No. 61/384,593 filed Sep. 20, 2010, titled "INTERCONNECT OR TERMINATION METHODOLOGY FOR E-TEXTILES", the complete subject matter of which is hereby expressly incorporated by reference in its entirety.

The present application relates to U.S. patent application having, Ser. No. 13/236,380 titled "CONNECTORS FOR E-TEXTILES" and filed on the same day as the present application, the complete subject matter of which is hereby expressly incorporated by reference in its entirety.

BACKGROUND OF THE INVENTION

The subject matter herein relates generally to electronic textiles, and more particularly, to termination methods and interconnects for electronic textiles.

Electronic textiles (e-textiles) are known and used as wearable technology, such as intelligent clothing or smart clothing, that allow for the incorporation of built-in technological elements in textiles and/or clothes. E-textiles may be used in many different applications, including first responder (e.g. fire and police) worn electronics systems, maintenance technician worn electronics systems, soldier worn electronics systems and the like. E-textiles are typically fabrics that enable computing, digital components and electronics to be embedded in them. E-textiles typically have electronic devices, such as conducting wires, integrated circuits, LEDs, conventional batteries and the like, mounted into garments. Some e-textiles have electronic functions incorporated directly on the textile fibers.

Known e-textiles are not without disadvantages. For example, the means of attaching or terminating electronic interconnects directly to the fabric is accomplished by means of soldering or crimping. Soldering poses an issue because it is difficult to strip un-insulated conductive fibers from the surrounding woven fabric's insulative material. Additionally, the woven fabric's insulative material cannot withstand the high temperatures of soldering. Furthermore, crimping to un-insulated conductive fibers of e-textiles has proven less reliable and difficult. For example, known e-textiles use a crimp similar to crimps used for Flat Flex Circuits (FFC). However, because the un-insulated conductive fibers are woven into the fabrics, the terminals crimped to the fabrics have few points of contact with the conductive fibers, and thus the electrical connection therebetween is less reliable. For example, the electrical connection has high resistance and/or intermittent signals.

A need remains for a termination method for e-textiles that creates a more reliable connection in terms of electrical conductivity and/or strength.

BRIEF DESCRIPTION OF THE INVENTION

In one embodiment, a connector is provided for an e-textile that has conductors that define a conductive layer of the e-textile. The connector has a terminal that may have a mating end and a mounting end. The mounting end is configured to be terminated to one or more of the e-textile's conductors. The mating end can be configured to be mated with a mating contact of a mating component and/or mating connector. The terminal has a body and a plurality of tines extending from the body. A base is separately provided from the terminal and is arranged opposite the body of the terminal such that the e-textile's conductor is positioned between the base and the body of the terminal. The terminal is crimped to electrically connect the terminal and the base to the e-textile's conductor. The tines are folded against or into the base to electrically connect the terminal to the base. The body of the terminal and the base are configured to engage the e-textile's conductors.

In another embodiment, an e-textile is provided having a conductive layer that includes conductors along with a separate connector having a terminal and a base separately provided from the terminal. The terminal has a mating end and a mounting end. The mounting end is terminated to the e-textile's conductors. The mating end is configured to be mated with a mating contact of a mating component and/or mating connector. The terminal has a body and a plurality of tines extending from the body. The base is arranged opposite the body of the terminal such that the conductors are positioned between the base and the body of the terminal. The terminal is crimped to electrically connect the terminal and the base to the e-textile's conductor. The tines are folded against or into the base to electrically connect the terminal to the base. The body of the terminal and the base engage the e-textile's conductors.

In a further embodiment, an e-textile is provided having a conductive layer that includes conductors along with a separate connector having a terminal that has a mating end and a mounting end with the mounting end being terminated to the e-textile's conductors. The mating end is configured to be mated with a mating contact of a mating component. The terminal has a body that is ultrasonically welded to the e-textile's conductor. Optionally, a base may be arranged and provided on the opposite side of the e-textile's conductor and ultrasonically welded to the e-textile's conductor with the terminal welded on the opposite side of the e-textile's conductor.

DETAILED DESCRIPTION OF THE INVENTION

Figure 1:
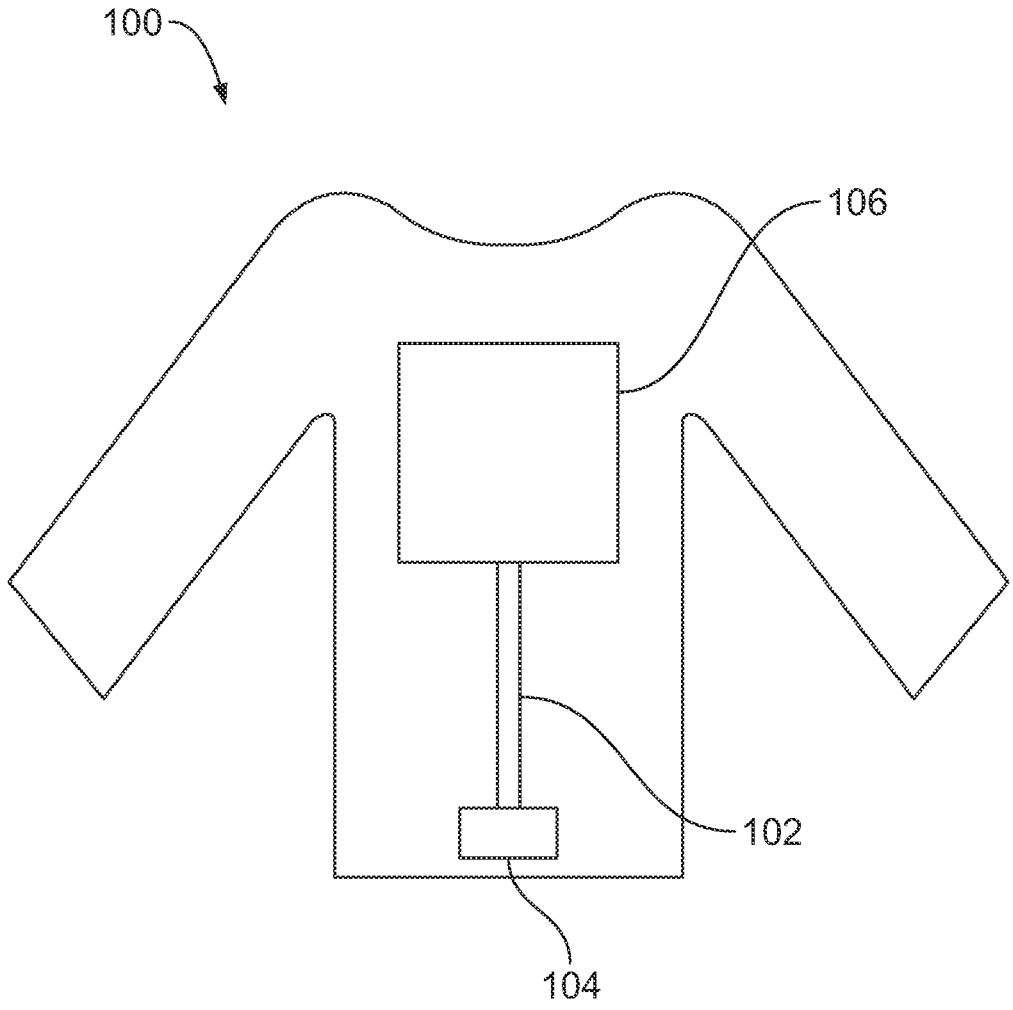
FIG. 1 illustrates a wearable article having an electronic textile therein.

FIG. 1 illustrates a wearable article 100, such as a garment, that incorporates an electronic textile (e-textile) 102 therein. The e-textile 102 includes fabrics that enable computing, digital components and/or electronics to be embedded therein. The e-textile 102 provides the wearable article 100 with wearable technology that allow for the incorporation of built-in technological elements into the fabric of the garment. The wearable article 100 may constitute intelligent clothing or smart clothing.

The e-textile 102 extends between a first electronic device 104 and a second electronic device 106. Any number of electronic devices may be utilized with the wearable article 100. In an exemplary embodiment, the first electronic device 104 constitutes a battery pack and the second electronic device 106 constitutes an LED array that may be powered by the battery pack. Other types of electronic devices may be incorporated into the wearable article 100 in alternative embodiments, such as a computer, personal radio, loop antenna, heating element, display screen, input device, sensor, induction loop or other components known to the industry.

Figure 2:
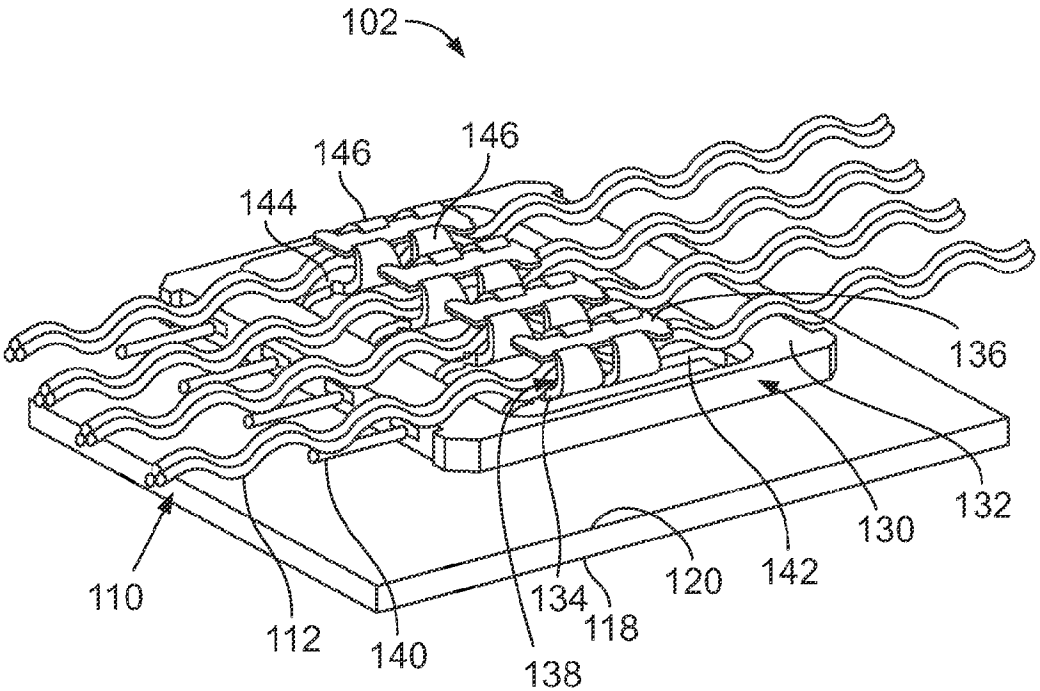
FIG. 2 is a top perspective view of a portion of an electronic textile and connector formed in accordance with an exemplary embodiment showing terminals of the connector crimped to conductors of the electronic textile.

FIG. 2 is a perspective view of a portion of the e-textile 102 formed in accordance with an exemplary embodiment. The e-textile 102 includes a conductive layer 110 having a plurality of uninsulated conductors 112 woven into fabric 114 (shown in FIG. 3) making up the conductive layer 110. The uninsulated conductors 112 may include an outer conductive layer wrapped around polymer strands, yarns or fibers. The outer conductive layer defines a conductive area of the conductor 112.

The uninsulated conductors 112 are woven into the insulative fabric 114 such that the conductors 112 have a woven shape, where the conductors 112 weave between both opposing sides of the fabric 114. The e-textile 102 may have any number of layers and the conductors 112 may be provided in one or more of the layers. The layers may or may not be constructed as a weave, where a weft fiber and warp fiber are bi-directionally woven together. The conductors 112 are woven into the fabric 114 such that portions of the conductors 112 are exposed along a first surface 118 of the fabric 114 and portions of the conductors 112 are exposed along a second surface 120 of the fabric 114. The conductors 112 follow generally parallel paths through the fabric 114. The conductors 112 may be arranged at a predetermined spacing or pitch.

The e-textile 102 includes a connector 130 that is electrically connected to the conductors 112. The connector 130 provides an interface for the e-textile 102 for mating with the electronic device 104 or 106 (both shown in FIG. 1). The connector 130 includes a housing 132 that holds a plurality of terminals 134 and/or bases 136 that cooperate with the terminals 134 to electrically connect the terminals 134 to the conductors 112. The connector 130 may include other components in addition to those illustrated herein, such as a cover, a shield, other mating components, and the like. The cover may provide protection from the surrounding environment. The cover may position the connector 130 with respect to other components of the e-textile 102 and/or the wearable article 100, such as for securing the connector 130 thereto or for impedance control, such as by positioning the connector 130 (and the terminals 134 and bases 136) at predetermined distances from other components, such as an electrical shield, to achieve a target impedance for the connector 130, such as a characteristic impedance value of 50, 75, 90 or 100 Ohms with allowable tolerances. The shield may provide electrical shielding for the connector 130. The shield may be a separate component provided as part of the connector. The shield may be connected to other shielded components to facilitate shielding for the system.

Optionally, the terminals 134 may be formed as part of a leadframe with a carrier extending therebetween that is later entirely or selectively removed to separate one or more of the terminals 134. The bases 136 are separate from, and spaced apart from, the terminals 134 such that a receiving space 138 is defined therebetween. The conductors 112 extend through the receiving space 138 between the terminals 134 and corresponding bases 136 and are compressed between the terminals 134 and corresponding bases 136 to electrically connect the terminals 134 to the conductors 112.

A compressive crimp electrically connects the terminals 134 and the bases 136 to the conductors 112. The terminals 134 are crimped during a crimping process in which the bases 136 are compressed toward the terminals 134, sandwiching the conductors 112 between the terminals 134 and the bases 136. The compressive crimp helps to ensure adequate electrical connection between the terminals 134 and the conductors 112 exposed along the first surface 118 of the fabric 114 and between the bases 136 and the conductors 112 exposed along the second surface 120. When the terminals 134 are crimped, portions of the terminals 134 engage the bases 136 such that the terminals 134 and the bases 136 are electrically connected together. When crimped, the terminals 134 force the bases 136 against the conductors 112. As the bases 136 are compressed downward against the conductors 112 and the fabric 114, the conductors 112 and the fabric 114 are also pressed downward against the terminals 134. As such, the conductors 112 are compressed against the terminals 134 and the bases 136 thus making a more reliable electrical connection between the conductors 112, the terminals 134 and the bases 136 due to the increased surface area and/or points of contact.

In an exemplary embodiment, both the terminal 134 and the base 136 increase the surface area and/or create multiple points of contact with the corresponding conductor 112. For example, the conductor 112 may be exposed at more than one longitudinal spaced apart location along the first surface 118 and at more than one longitudinal spaced apart location along the second surface 120. Where the conductor 112 is exposed at the first surface 118, the terminal 134 makes directs electrical contact with the conductor 112. Where the conductor 112 is exposed at the second surface 120, the base 136 makes directs electrical contact with the conductor 112. The terminals 134 and bases 136 are spaced apart from other terminals 134 and bases 136 to achieve a target impedance for the connector 130.

Figure 3:
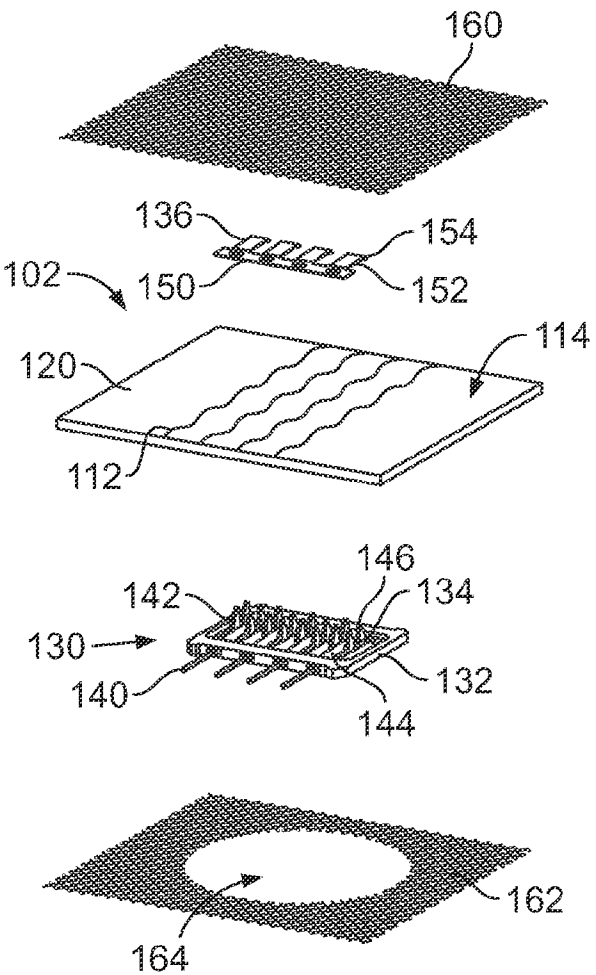
FIG. 3 is an exploded view of the electronic textile shown in FIG. 2 with the terminals uncrimped.

FIG. 3 is an exploded view of the e-textile 102. The connector 130 includes the housing 132 which holds the terminals 134. In an exemplary embodiment, the housing 132 is a plastic component that holds each of the terminals 134 in a spaced apart relation. Optionally, the terminals 134 may be overmolded by a plastic material, which forms the housing 132.

Each terminal 134 includes a mating end 140 and a mounting end 142 opposite the mating end 140. The mounting end 142 is configured to be mounted to the corresponding conductor 112. The mating end 140 is configured to be mated with a mating contact of a mating component, such as a mating connector of the electronic device 104 or 106 (shown in FIG. 1).

The terminal 134 has a body 144 extending between the mating and mounting ends 140, 142. A plurality of tines 146 extend from the body 144. In an exemplary embodiment, the body 144 may be generally planar at the mounting end 142. The tines 146 extend generally perpendicular from the body 144. In an exemplary embodiment, distal ends of the tines 146 may be pointed. The tines 146 are configured to be pressed and pierced through the insulative fabric 114. The tines 146 are then crimped by bending the tines 146 and/or folding the tines 146 inward. Any number of tines 146 may be provided. In an exemplary embodiment, the tines 146 are provided on both sides of the body 144. A space is defined between the tines 146 on opposite sides of the body 144. The conductor 112 is received in the space between the tines 146 on the opposite sides of the body 144.

In an exemplary embodiment, the bases 136 are held by a carrier 150. The carrier 150 holds the bases 136 in a spaced apart relation that corresponds with the spacing between the terminals 134. In the illustrated embodiment, the carrier 150 constitutes a carrier strip, wherein the bases 136 and the carrier strip are stamped from a common blank. The carrier strip is integrally formed with the bases 136 and is formed from the same material. Optionally, the carrier 150 may be removed after the terminals 134 are crimped. Alternatively, the carrier 150 may remain intact and coupled to the bases 136 after the terminals 134 are crimped. When the carrier 150 remains, the bases 136 are electrically connected together. When the carrier 150 remains, the bases 136, the terminals 134 and the conductors 112 are ganged together to increase the current carrying capacity of a common circuit created by the carrier 150.

The connector 130 may be programmable by selecting certain combinations of the bases 136 and/or terminals 134 to remain electrically commoned together. Selected terminals 134 and/or bases 136 may be ganged together to perform a common function, such as to transmit power or data along each of the ganged terminals 134 and/or bases 136. Different sets of terminals 134 and/or bases 136 may be ganged together in different embodiments depending on the particular application. For example, the terminals 134 and/or bases 136 may be initially formed as a lead frame with connecting segments between each of the terminals 134 or the bases 136 such that all of the terminals 134 or bases 136 are initially connected together. Any of the connecting segments may be removed, such as by cutting the connecting segment, to separate the adjacent terminals 134 or bases 136 from one another. Depending on which connecting segments are removed, the terminals 134 and/or bases 136 may cooperate with one another to perform a common function.

The bases 136 are generally planar and have a first side 152 and a second side 154. The bases 136 are mounted to the fabric 114 such that the first side 152 of the bases 136 face, and engage, the exposed portions of the conductors 112 on the second surface 120 of the fabric 114. When the tines 146 are crimped, the tines 146 are folded inward onto the bases 136. The tines 146 engage the second side 154 of the bases 136 and push the bases 136 downward toward the conductors 112 and the body 144 of the terminals 134. Optionally, the tines 146 may pierce through the bases 136 when the tines 146 are crimped. During the crimping process, the bases 136 are forced downward toward the body 144, which compresses the conductors 112 and the fabric 114. Such compression ensures more reliable electrical contact between the bases 136 and the terminals 134 with the conductors 112. The conductors 112 may be at least partially flattened when compressed, creating a larger surface area for the bases 136 and the terminals 134 to engage.

Outer fabric layers 160, 162 may be provided on one or both sides of the e-textile 102. The outer fabric layers 160, 162 may define the exposed layers of the wearable article 100 (shown in FIG. 1). The outer fabric layer 162 has a window 164 that provides access to the e-textile 102. The connector 130 may extend through the window 164 for making electrical connection to the electronic device 104 or 106.

Figure 4:
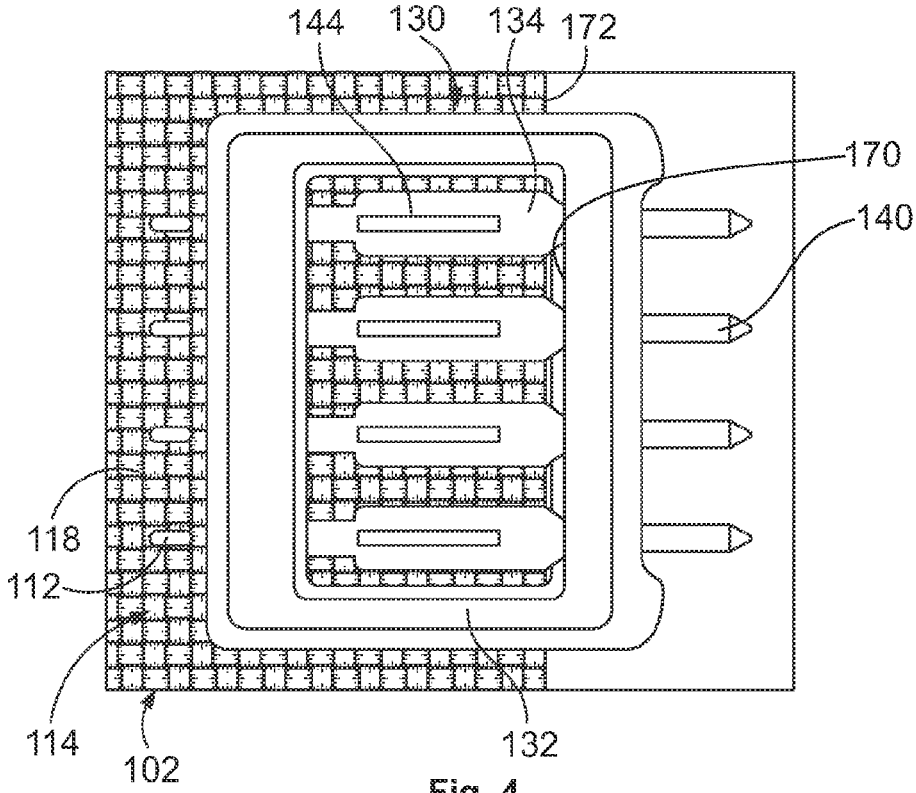
FIG. 4 is a top view of a connector mounted to the electronic textile shown in FIG. 2.
Figure 5:
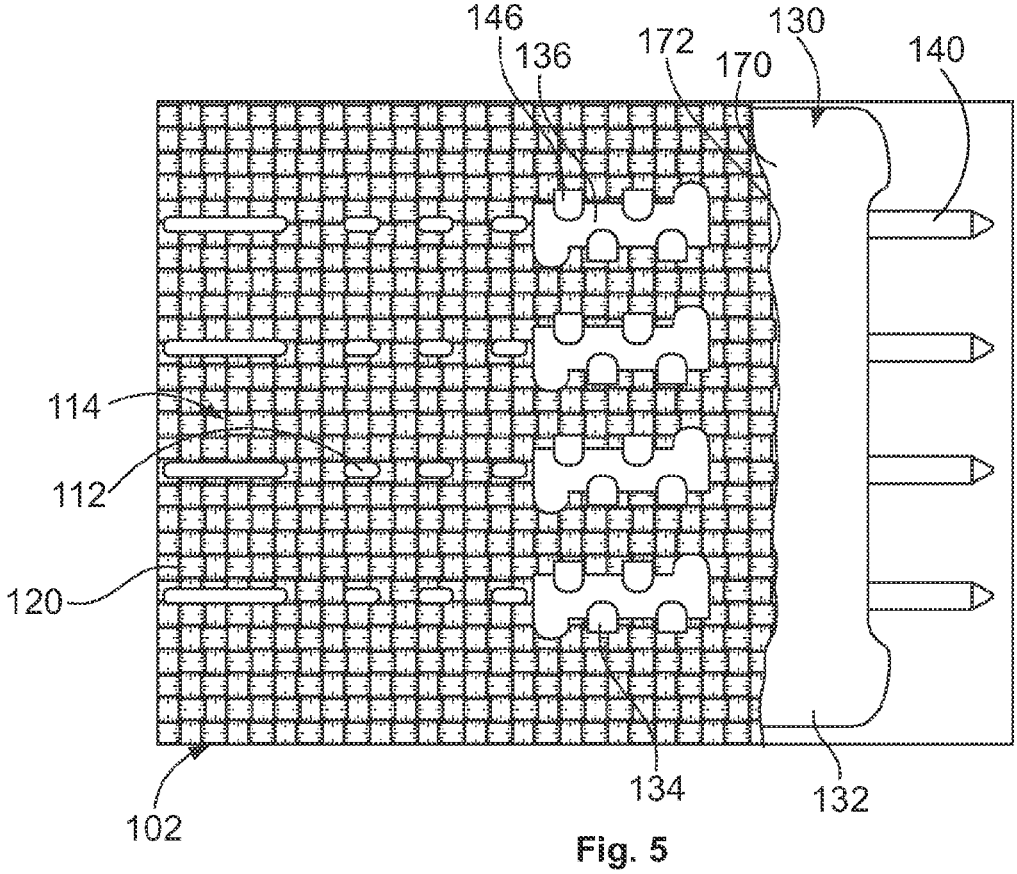
FIG. 5 is a bottom view of the connector mounted to the electronic textile shown in FIG. 2.

FIG. 4 is a top view of the connector 130 mounted to the e-textile 102. FIG. 5 is a bottom view of the connector 130 mounted to the e-textile 102. The conductors 112 are illustrated woven through the fabric 114 and being exposed along the first surface 118 and the second surface 120.

The housing 132 holds the terminals 134 for coupling the terminals 134 to the conductors 112. The mating ends 140 extend forward from the housing 132 and are positioned for mating with a mating component, such as the electronic device 104 or 106 (shown in FIG. 1). The housing 132 includes a lip 170 proximate a front edge thereof. The housing 132 is positioned on the fabric 114 such that the lip 170 rests against an edge 172 of the fabric 114. Having the lip 170 rest against the edge 172 positions the connector 130 with respect to the fabric 114 and conductors 112.

As shown in FIG. 5, the tines 146 of the terminals 134 are crimped against the bases 136. During the crimping process, as the tines 146 are pierced through the fabric and folded over, the tines 146 press against the bases 136 which forces the bases 136 and the body 144 (shown in FIG. 4) of the terminals 134 to be pressed toward one another. As the bases 136 and the body 144 are pressed toward one another, the fabric 114 and conductors 112 are compressed. The bases 136 are pressed against the exposed portions of the conductors 112 on the second surface 120. The bodies 144 are pressed against the exposed portions of the conductors 112 on the first surface 118. Having the tines 146 of the terminals 134 piercing through the insulative fabric 114 and/or compression of the terminals 134 and the bases 136 provide strain relief between the connector 130 and the e-textile 102.

The compressive crimp provides a more reliable electrical connection between the terminals 134 and bases 136 and the conductors 112. Because the conductors 112 along both longitudinal surfaces 118, 120 are compressed during the crimping process, the contact area between the bodies 144, the bases 136 and the conductors 112 are increased. Optionally, the conductors 112 may be at least partially flattened out during the compression thereof, increasing the amount of contact area of the conductors 112. The increased contact area allows an increase in the current carrying capability of the connection between the connector 130 and the e-textile 102.

Optionally, each of the bases 136, or any number of the bases 136, may be electrically connected together using the carrier 150 (shown in FIG. 3). In the illustrated embodiment, the carrier 150 has been removed. However, in some embodiments, the carrier 150 may remain coupled to any or all of the bases 136, thus electrically connecting such bases together. Having the bases 136 ganged together increases the current carrying capacity of the electrical circuits and/or common circuits.

The mating ends 140 constitute pin contacts that are configured to be received in sockets of the mating connector. Other types of mating interfaces may be provided at the mating ends 140, such as socket contacts, spring contacts, or other mating interfaces known to the industry.

Figure 6:
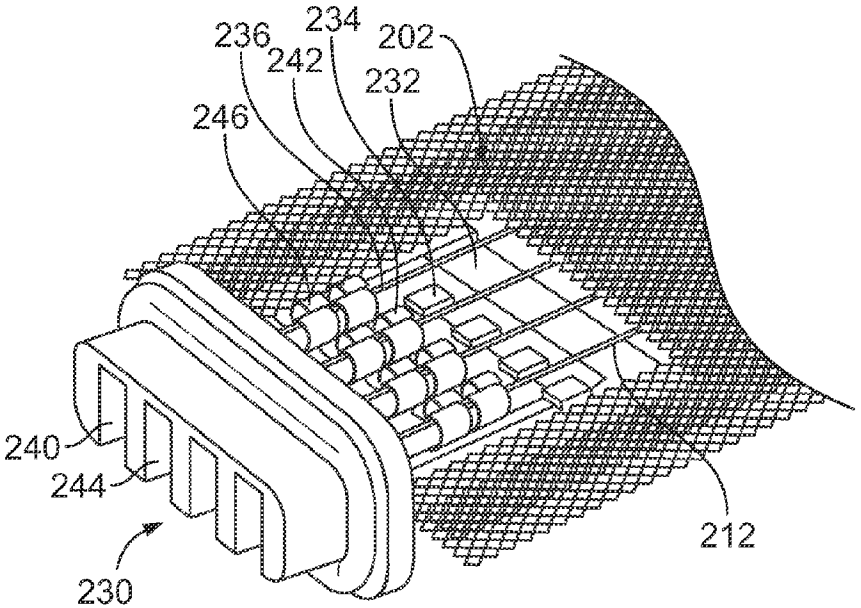
FIG. 6 is a front perspective view of an exemplary connector mounted to an electronic textile in accordance with an exemplary embodiment.

FIG. 6 is a front perspective view of an alternative connector 230 coupled to an e-textile 202, which may be substantially similar to the e-textile 102 (shown in FIGS. 1-5). The connector 230 includes a housing 232 that holds a plurality of terminals 234. The terminals 234 cooperate with bases 236 to create an electrical connection with conductors 212 of the e-textile 202. The connector 230 may include other components in addition to those illustrated herein, such as a cover, other mating components, and the like.

Each terminal 234 extends between a mating end 240 and a mounting end 242. The mounting end 242 is substantially similar to the mounting end 142 (shown in FIG. 3). The terminal 234 may be electrically connected to the conductor 212 in a similar manner as described above with respect to the terminal 134 (shown in FIG. 3). The mating end 240 has a different mating interface than the mating end 140 (shown in FIG. 3) of the terminal 134. The mating end 240 includes a contact pad 244 that is configured to be mated with a complementary contact spring beam of a mating connector. Alternatively, the mating end 240 may constitute a spring beam that is configured to be mated with a contact pad of a mating connector.

The terminal 234 includes tines 246 that are folded over during a crimping process. The tines 246 press against the base 236 to compressively crimp the terminal 234 and base 236 to the corresponding conductor 212.

Figure 7:
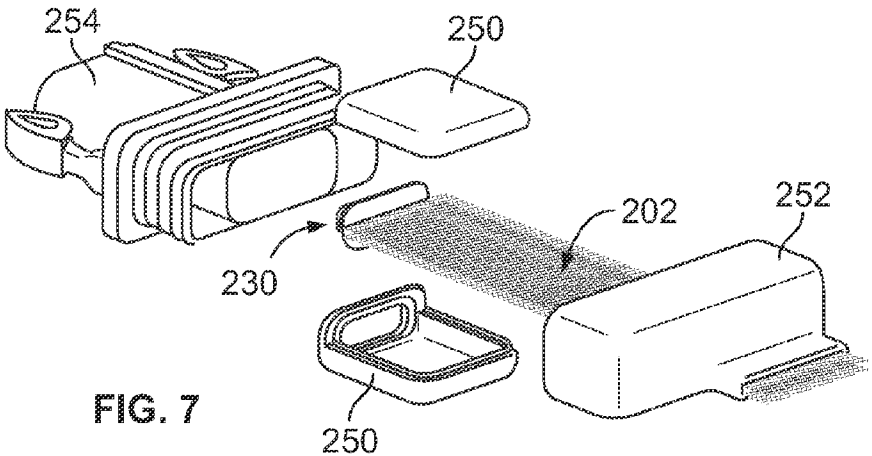
FIG. 7 is an exploded view of the connector and the electronic textile shown in FIG. 6.

FIG. 7 is an exploded view of the connector 230 and the e-textile 202. The connector 230 includes a shell 250 that is configured to surround the housing 232. A boot 252 surrounds the e-textile 202 and is configured to be loaded over the shell 250 after the shell 250 is mounted to the connector 230. The boot 252 may provide strain relief and an environmental seal between the connector 230 and the e-textile 202. A mounting clip 254 is coupled to the front end of the boot 252 and the connector 230. The mounting clip 254 is used to mate the connector 230 with the mating connector.

Figure 8:
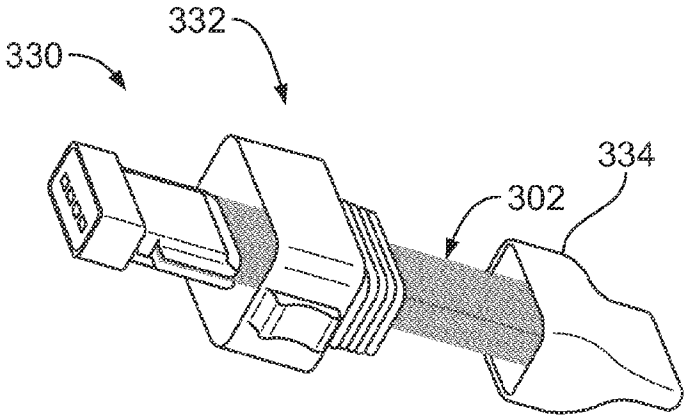
FIG. 8 is a partially assembled view of an alternative connector mounted to an electronic textile.

FIG. 8 illustrates an alternative connector 330 that is mounted to an e-textile 302, that may be similar to the e-textiles 102, 202 (shown in FIGS. 1-7). The connector 330 is terminated to conductors of the e-textile 302 in a similar manner as described above.

A housing 332 is mounted to the e-textile 302 around the connector 330. The housing 332 is used to couple the connector 330 and e-textile 302 to a mating connector. A boot 334 is provided on the e-textile 302 and may be slid over a rear end of the connector 330 and the housing 332 to provide strain relief and an environmental seal. The connector 330 may include other components in addition to those illustrated herein, such as a cover, a shield, other mating components, and the like.

Figure 9:
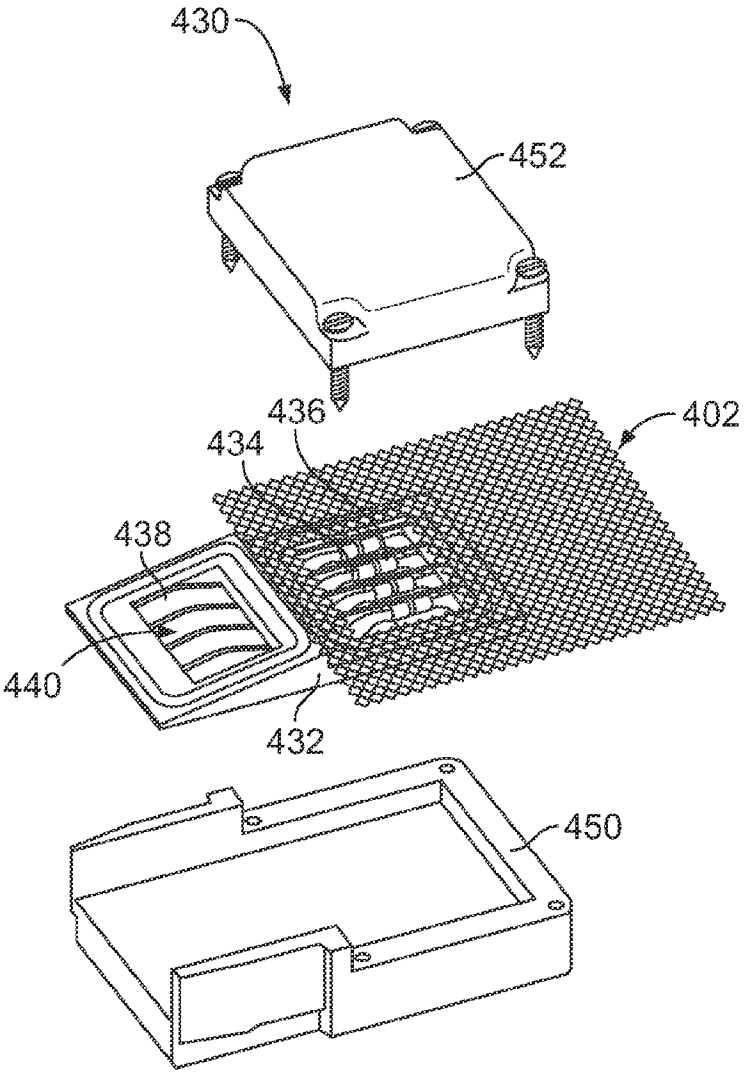
FIG. 9 is an exploded view of another alternative connector mounted to an electronic textile.

FIG. 9 illustrates an alternative connector 430 that is mounted to an e-textile 402. The connector 430 includes a housing 432 that holds a plurality of terminals 434. The terminals 434 cooperate with bases 436 to compressively crimp the terminals 434 to conductors of the e-textile 402. The terminals 434 include spring beams 438 at mating ends 440 thereof. A housing 450 receives the housing 432 and a cap 452 is coupled to the housing 450 to capture the connector 430 and the e-textile 402 therebetween. The connector 430 may include other components in addition to those illustrated herein, such as a cover, a shield, other mating components, and the like.

Figure 10:
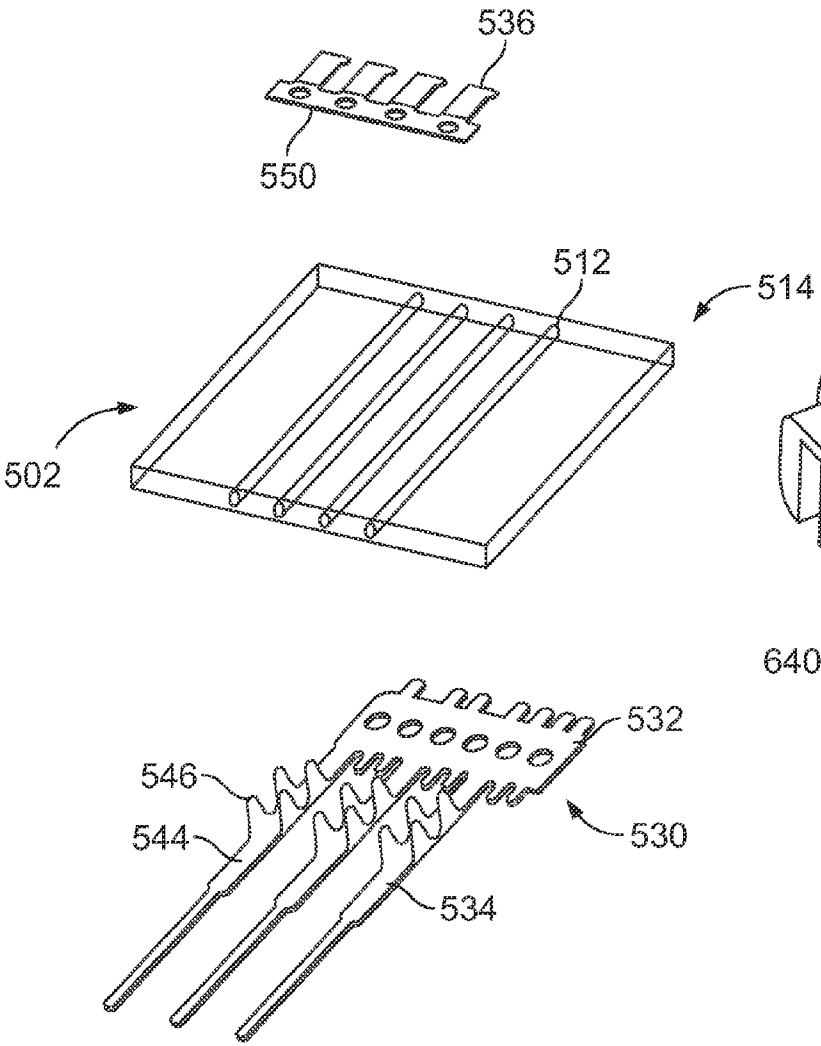
FIG. 10 is an exploded view of a portion of another alternative connector poised for mounting to an electronic textile.

FIG. 10 is an exploded view of an alternative connector 530 that is mounted to an e-textile 502. The connector 530 includes a carrier 532 that holds a plurality of terminals 534. In the illustrated embodiment, the carrier 532 constitutes a carrier strip that is integrally formed with the terminals 534. The carrier 532 and the terminals 534 are stamped from a common blank. The carrier 532 and the terminals 534 are manufactured from the same material during a common forming process. Optionally, the carrier 532 may be removed from the terminals 534 after the terminals 534 are crimped to the conductors 512 of the e-textile 502. Alternatively, the carrier 532 may remain attached to terminals 534. The carrier 532 may thus be used to gang the terminals 534 together to increase the current carrying capacity and/or common circuits as required by the application of the connector 530. The connector 530 may include other components in addition to those illustrated herein, such as a cover, a shield, other mating components, and the like.

Bases 536 are provided separately from terminals 534. A carrier 550 holds the bases 536. In the illustrated embodiment, the carrier 550 constitutes a carrier strip that is integrally formed with the bases 536. The carrier 550 and the bases 536 are stamped from a common blank. The carrier 550 and the bases 536 are manufactured from the same material during a common forming process. Optionally, the carrier 550 may be removed from the bases 536 after the bases 536 and terminals 534 are crimped to the conductors 512 of the e-textile 502. Alternatively, the carrier 550 may remain attached to bases 536. The carrier 550 may thus be used to gang the bases 536 together to increase the current carrying capacity and/or common circuits as required by the application of the connector 530.

Each terminal 534 includes a body 544 and tines 546 extending from the body 544. The tines 546 extend through the fabric of the e-textile 502 and are crimped during a crimping process. When the tines 546 are crimped, the base 536 is pressed downward towards the body 544 of the terminal 534. The compression of the base 536 causes the fabric 514 and conductor 512 of the e-textile 502 to be compressed. Such compression crimp creates a more reliable electrical connection between the terminal 534 and base 536 and the conductor 512 due to the increased surface area and/or points of contact.

Figure 11:
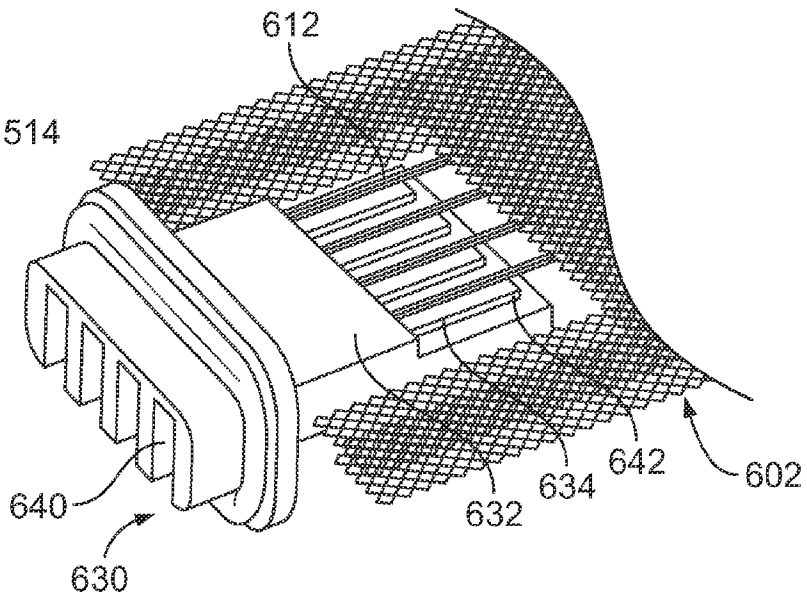
FIG. 11 is a perspective view of another alternative connector mounted to an electronic textile.

FIG. 11 is a front perspective view of an alternative connector 630 mounted to an e-textile 602. The connector 630 includes a housing 632 that holds a plurality of terminals 634. The terminals 634 have mating ends 640 and mounting ends 642. The mating ends 640 are configured to be electrically connected to a mating connector. The mounting ends 642 are configured to be electrically connected to conductors 612 of the e-textile 602. The connector 630 may include other components in addition to those illustrated herein, such as a cover, a shield, other mating components, and the like.

In an exemplary embodiment, the mounting ends 642 of the terminals 634 are ultrasonically welded to the conductors 612. During the ultrasonic welding process, high frequency ultrasonic acoustic vibrations are locally applied to the terminals 634 under pressure to create a solid state weld between the terminals 634 and the conductors 612. Optionally, bases or slave pieces (not shown) may be provided on opposite sides of the conductors 612 from the terminals 634. The conductors 612 may be ultrasonically welded to, and between, the bases or slave pieces and the terminals 634.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector for an e-textile having conductors defining a conductive layer of the e-textile, the connector comprising:

a terminal having a mating end and a mounting end, the mounting end being configured to be terminated to one or more of the e-textile's conductors, the mating end being configured to be mated with a mating contact of a mating component, the terminal having a body and a plurality of tines extending from the body; and a base separately provided from the terminal and arranged opposite the body of the terminal such that at least one of the e-textile's conductors are positioned between the base and the body of the terminal;

wherein the tines are configured to be pressed through the e-textile and crimped to electrically connect the terminal and the base to the e-textile's conductor, the tines being folded against the base to electrically connect the terminal to the base, the body of the terminal and the base being configured to engage the e-textile's conductors.

2. The connector of claim 1, wherein the base is compressed toward the body when the tines are crimped.

3. The connector of claim 1, wherein the tines engage the base when the tines are crimped.

4. The connector of claim 1, wherein the base and body are parallel to one another and define a receiving space therebetween that receives the e-textile's conductors.

5. The connector of claim 1, wherein the tines engage the e-textile's conductors when the tines are crimped.

6. The connector of claim 1, wherein the e-textile's conductors are woven within a fabric layer such that the e-textile's conductors have a woven shape, the base and the body configured to receive both the fabric layer and the e-textiles conductors therebetween with the base having at least one point of contact with the e-textile's conductors, and with the body having at least one point of contact with the e-textile's conductors.

7. The connector of claim 1, wherein the connector includes a plurality of terminals and a plurality of bases associated with corresponding terminals, the terminals and corresponding bases being electrically connected to corresponding e-textile's conductors.

8. The connector of claim 7, further comprising a housing holding the terminals and the bases.

9. The connector of claim 7, further comprising a carrier extending between adjacent terminals or adjacent bases, the carrier electrically connecting the terminals or the bases to one another.

10. The connector of claim 7, wherein the terminals and bases are positioned at predetermined distances from one another to achieve a target impedance for the connector.

11. An e-textile comprising:

a conductive layer comprising conductors; and a connector comprising a terminal and a base separately provided from the terminal, the terminal having a mating end and a mounting end, the mounting end being terminated to the conductors, the mating end being configured to be mated with a mating contact of a mating component, the terminal having a body and a plurality of tines extending from the body, the base being arranged opposite the body of the terminal such that the conductors are positioned between the base and the body of the terminal, wherein the tines are configured to be pressed through the e-textile and crimped to electrically connect the terminal and the base to the conductor, the tines being folded against the base to electrically connect the terminal to the base, the body of the terminal and the base engaging the conductors.

12. The e-textile of claim 11, wherein the base is compressed toward the body when the tines are crimped.

13. The e-textile of claim 11, wherein the tines engage the base when the tines are crimped.

14. The e-textile of claim 11, wherein the base and body are parallel to one another and define a receiving space therebetween that receives the conductors.

15. The e-textile of claim 11, wherein the tines engage the conductors when the tines are crimped.

16. The e-textile of claim 11, wherein the conductors are woven within a fabric layer such that the conductors have a serpentine shape, the base and the body receiving both the fabric layer and the e-textiles conductors therebetween with the base having at least one point of contact with the conductors, and with the body having at least one point of contact with the conductors.

17. The e-textile of claim 11, wherein the connector includes a plurality of terminals and a plurality of bases associated with corresponding terminals, the terminals and corresponding bases being electrically connected to corresponding conductors.

18. The e-textile of claim 17, further comprising a housing holding the terminals and the bases.

19. The e-textile of claim 17, further comprising a carrier extending between adjacent terminals or adjacent bases, the carrier electrically connecting the terminals or the bases to one another.

20. The e-textile of claim 17, wherein the plurality of terminals form a programmable leadframe having the plurality of the terminals electrically connected to corresponding conductors, different combinations of the terminals being configured to be ganged together to transmit common data or power signals transmitted by the conductors.

21. An e-textile comprising:

a conductive layer comprising conductors; and a connector comprising a terminal having a mating end and a mounting end, the mounting end being terminated to at least one of the conductors, the mating end being configured to be mated with a mating contact of a mating component, the terminal having a body, the connector having a base separately provided from the terminal and positioned opposite the body of the terminal such that at least one of the conductors are arranged between the body and the base, the body and the base being ultrasonically welded to at least one of the conductors.

22. The e-textile of claim 21, wherein the conductors are woven within a fabric layer such that the conductors have a serpentine shape, the base and the body receiving both the fabric layer and the e-textiles conductors therebetween with the base having at least one point of contact with the conductors, and with the body having at least one point of contact with the conductors, the base and the body being ultrasonically welded to the conductors at the at least one point of contact.

* * * * *